US012729489B2

(12) United States Patent
Max-Theurer et al.

(10) Patent No.: US 12,729,489 B2
(45) Date of Patent: Sep. 8, 2026

(54) ON-TRACK MAINTENANCE MACHINE AND METHOD FOR OPERATING THE MACHINE

(71) Applicant: Plasser & Theurer Export von Bahnbaumaschinen Gesellschaft m.b.H., Vienna (AT)

(72) Inventors: Johannes Max-Theurer, Vienna (AT); Florian Auer, Vienna (AT); Michael Klement, Vienna (AT)

(73) Assignee: Plasser & Theurer Export von Bahnbaumaschinen Gesellschaft m.b.H, Vienna (AT)

( * ) Notice: Subject to any disclaimer, the term of this patent is extended or adjusted under 35 U.S.C. 154(b) by 586 days.

(21) Appl. No.: 18/272,632

(22) PCT Filed: Jan. 19, 2022

(86) PCT No.: PCT/EP2022/051117
§ 371 (c)(1),
(2) Date: Jul. 17, 2023

(87) PCT Pub. No.: WO2022/171410
PCT Pub. Date: Aug. 18, 2022

(65) Prior Publication Data

US 2024/0318386 A1 Sep. 26, 2024

(30) Foreign Application Priority Data

Feb. 10, 2021 (AT) ..... A 50081/2021

(51) Int. Cl.

| | |
|---|---|
| ***E01B 27/17*** | (2006.01) |
| ***E01B 27/16*** | (2006.01) |
| ***E01B 29/04*** | (2006.01) |
| ***E01B 29/14*** | (2006.01) |
| ***E01B 31/12*** | (2006.01) |

(Continued)

(52) U.S. Cl.
CPC ..... *E01B 27/17* (2013.01); *E01B 27/16* (2013.01); *E01B 29/04* (2013.01); *E01B 29/14* (2013.01);

(Continued)

(58) Field of Classification Search
CPC ..... E01B 27/17; E01B 27/16; E01B 29/04; E01B 29/14; E01B 31/12; E01B 31/13; E01B 31/15
See application file for complete search history.

(56) References Cited

U.S. PATENT DOCUMENTS 4,630,541 A * 12/1986 Theurer ..... E01B 27/17 104/7.2
4,643,101 A 2/1987 Theurer
(Continued)

FOREIGN PATENT DOCUMENTS

AT 380 280 B 5/1986
AT 507895 B1 * 9/2010 ..... E01B 27/17
(Continued)

OTHER PUBLICATIONS

International Search Report in PCT/EP2022/051117 dated Apr. 14, 2022.

*Primary Examiner* — Cheng Lin
(74) *Attorney, Agent, or Firm* — Collard & Roe, P.C.

(57) ABSTRACT

The invention relates to an on-track maintenance machine for maintaining a superstructure with a track panel formed of sleepers and rails fixed thereon that is supported on a ballast bed, comprising a lifting and lining unit for track lifting and lining and a tamping unit for track tamping. In the invention, at least one rail treatment unit for continuous reprofiling of the rails is arranged on a machine frame. The elimination of rail defects contributes to a higher durability of the corrected (Continued)

track position, as after re-opening the treated track section, the rails can be used again trouble-free.

14 Claims, 2 Drawing Sheets

(51) Int. Cl.
*E01B 31/13* (2006.01)
*E01B 31/15* (2006.01)

(52) U.S. Cl.
CPC ..... *E01B 31/12* (2013.01); *E01B 31/13* (2013.01); *E01B 31/15* (2013.01)

(56) References Cited

U.S. PATENT DOCUMENTS

| | | | | | |
|---|---|---|---|---|---|
| 4,939,998 | A * | 7/1990 | Theurer | E01B 27/16 | 104/9 |
| 5,660,112 | A * | 8/1997 | Theurer | E01B 27/17 | 104/2 |
| 8,113,120 | B2 * | 2/2012 | Theurer | E01B 27/17 | 104/2 |
| 9,605,387 | B2 * | 3/2017 | Dehmel | E01B 27/00 | |
| 2015/0330034 | A1 * | 11/2015 | Mevert | B23C 5/2295 | 409/178 |

FOREIGN PATENT DOCUMENTS

| | | | | |
|---|---|---|---|---|
| CN | 104612005 | A * | 5/2015 | E01B 31/13 |
| DE | 28 49 263 | A1 | 8/1979 | |
| EP | 0223895 | A1 * | 6/1987 | E01B 31/08 |
| EP | 0 732 451 | A1 | 9/1996 | |
| JP | 2004514815 | A | 5/2004 | |
| JP | 2015218578 | A | 12/2015 | |
| WO | 02/46531 | A1 | 6/2002 | |
| WO | 2012/156417 | A1 | 11/2012 | |

* cited by examiner

ON-TRACK MAINTENANCE MACHINE AND METHOD FOR OPERATING THE MACHINE

CROSS REFERENCE TO RELATED APPLICATIONS

This application is the National Stage of PCT/EP2022/051117 filed on Jan. 19, 2022, which claims priority under 35 U.S.C. § 119 of Austrian Application No. A 50081/2021, filed on Feb. 10, 2021, the disclosure of which is incorporated by reference. The international application under PCT article 21 (2) was not published in English.

FIELD OF TECHNOLOGY

The invention relates to an on-track maintenance machine for maintaining a superstructure with a track panel formed of sleepers and rails fixed thereon that is supported on a ballast bed, comprising a lifting and lining unit for track lifting and lining and a tamping unit for track tamping. The invention further relates to a method for operating the machine.

PRIOR ART

The superstructure of a track is subject to constant wear due to use and weather influences, which means that regular maintenance work is necessary. In the case of a ballasted track, the ballast bed, the track panel consisting of rails and sleepers as well as turnouts and crossings are to be maintained in particular. For this purpose, the condition of the individual track objects and the position of the track panel in the ballast bed are checked at predefined intervals. Actual data of the superstructure, which are obtained by means of various known measuring methods and measuring devices, provide the basis for this. Work on the track is usually carried out by means of an on-track maintenance machine. Such machines are also called track construction machine or railway construction machine.

AT 518692 A1 discloses a method for detecting track objects and a maintenance system. The maintenance system is used, for example, for measuring the track position; for lifting, lining, and tamping the track; for measuring the course of the contact wire; or for measuring the rail profile. First, deviations of the recorded actual condition from a specified target condition are evaluated and correction data is provided. This data is then used to actuate the maintenance work units of an on-track maintenance machine, for example a lifting and lining unit and a tamping unit.

PRESENTATION OF THE INVENTION

The object of the invention is to improve an on-track maintenance machine of the kind mentioned above in such a way that maintaining a track section can be carried out with high quality in short track possessions. In particular, the processes of the work to be carried out are to be synchronized in an optimized manner. A further object of the invention is to indicate a corresponding method.

According to the invention, these objects are achieved by the features of independent claims 1 and 12. Dependent claims indicate advantageous embodiments of the invention.

In the invention, at least one rail treatment unit for continuous reprofiling of the rails is arranged on a machine frame of the on-track maintenance machine. In this way, the machine enables both the correction of the track position and the machine-integrated reprofiling of the rails during a working run. The elimination of rail defects, in particular existing rolling contact fatigue damages, contributes to a higher durability of the corrected track position, as after re-opening the treated track section, the rails can be used again trouble-free. Without this measure, remaining rail defects would cause vibrations and jolting when travelling over them, which would result in a renewed deterioration of the track position after a short period of time.

Another advantage is an optimal working speed resulting from the combination of track lifting and lining, track tamping, and rail reprofiling in one maintenance machine. The advance speed of a tool for rail reprofiling is within a speed range that is typical for track tamping machines. Common values range between 1000 m/h and 2000 m/h. High-capacity tamping machines achieve a working speed of up to 3000 m/h. In this way, all work processes can be carried out at the same forward speed without having to put up with losses in the working performance of the respective maintenance unit.

In an advantageous further development, the rail treatment unit is arranged downstream of the lifting and lining unit and the tamping unit in a working direction. This ensures that the track panel is supported uniformly for the reprofiling of the rails. The track position correction and the tamping of the sleepers eliminates voids, if necessary. A vertical load of the rails in the course of reprofiling is consequently counteracted by supporting forces that are distributed uniformly across the rail bed.

Advantageously, the rail treatment unit comprises a milling tool, which in particular has a milling cutter head with an axis of rotation aligned transversely to a longitudinal direction of the machine. With a milling tool, sufficiently high material removal rates can be achieved in one pass so that even pronounced rail defects are removed. Here, the tamping of the sleepers carried out immediately beforehand is particularly advantageous because the milling tool and supporting sliding shoes press onto the assigned rail from above. A uniform support of the track panel leads to a milling result with high quality due to a stable track resistance in vertical direction.

An improvement of this further development provides that the rail treatment unit comprises several milling tools arranged one behind the other and that in particular a front milling tool is designed as a roughing cutter and a rear milling tool as a finishing cutter. This arrangement combines high material removal with a sufficiently smoothed rail surface. In a special variant, the milling tools arranged one behind the other are assigned to different sections of the rail head profile. This facilitates a continuous work on turnouts, because the milling tools can be used selectively in the area of the common crossing and the guard rails in order to take account of the restricted clearances.

In a further embodiment of the invention, the rail treatment unit comprises a planing tool which, in particular, has cutting bodies that are designed to be movable in relation to a base body. Due to the positive cutting edge geometry of the planing tool, no force acts on the rail from above. Movable cutting bodies also allow the cutting edges to be guided along the rail head surface in a slotted-guide-like manner. The result of such treatment is an almost uniformly smooth machining surface.

To further improve the quality of the treated rail head surfaces, a smoothing device, in particular a grinding tool, is arranged downstream of the rail treatment unit in the working direction. Such a smoothing device is used to remove any traces of engagement (knife strokes) of the reprofiling tool.

In another advantageous further development of the machine, the lifting and lining unit and the tamping unit are arranged on a separate machine frame; in particular, at least one of the machine frames is designed as a satellite frame shiftable in relation to a main frame in the longitudinal direction of the machine by means of a satellite drive. It is useful that each machine frame is supported on at least one rail-based running gear. In this way, an optimized load distribution is ensured. In addition, the advance speeds of the work units can be better matched to each other due to the structural decoupling.

The maintenance measures that can be carried out by means of the machine are further improved if at least one stabilizing unit is arranged downstream of the tamping unit in the working direction. By means of the stabilizing unit, the restored track position is permanently stabilized by inducing a controlled settlement in advance. The machine-integrated reprofiling of the rails overall results in a particularly sustainable way of working on the superstructure.

An improvement of the machine design provides that a first machine section comprises the lifting and lining unit and the tamping unit, and that a second machine section coupled to the first machine section comprises the rail treatment unit for reprofiling the rails. In this way, a modular design system can be implemented in which various embodiments of a tamping machine section can be combined with various embodiments of a machine section for rail reprofiling.

In an advantageous further development of this variant, an energy supply device is set up on one machine section, with the other machine section being connected to the energy supply device via a supply line. In addition, further system components of the one machine section can be used in the other machine section. For example, data from an assistance system present in the tamping machine section is also used in the machine section for rail reprofiling. The shared assistance system is used for automated or semi-automated actuation of all work units.

This embodiment of the invention is further improved in that the supply line has a detachable connection between the machine sections, with the second machine section comprising an energy storage and with the energy storage being chargeable via the supply line. In this way, the second machine section for rail reprofiling can be operated temporarily detached from the first machine section. The energy required for the rail treatment unit is much lower than the energy required for the tamping machine section. Therefore, the energy supply from the energy storage is possible without difficulty for the duration of at least one work operation.

In the method according to the invention for operating the maintenance machine, the track panel is lifted and lined on a track section by means of the lifting and lining unit, with the sleepers of the track panel being tamped by means of the tamping unit and the rails of the track panel being reprofiled by means of the rail treatment unit. This integrated method of work achieves, for the first time, the correction of the track position and the restoration of a rail head surface free from defects in one pass.

In an advantageous further development of the method, the lifting and lining unit and the tamping unit are moved forward in the working direction during successive work cycles, with the rail treatment unit for reprofiling the rails being moved continuously in the working direction at a speed adapted to a duration of the work cycles. In this way, the continuous rail treatment is optimally coordinated with the cyclical tamping of the sleepers.

In a further improvement of the method, the lifting and lining unit, the tamping unit, the rail treatment unit for reprofiling the rails, a machine traction drive and, if necessary, a satellite drive are actuated in a coordinated manner via a central control device. The central control device enables automated or semi-automated operation of the maintenance machine. Interruptions or variations in the tamping cycles and during rail treatment are also taken into account. As soon as one work unit deviates from normal operation, the other work unit(s) is or are actuated accordingly.

In an advantageous variant of the method, a machine section with the rail treatment unit for reprofiling the rails is uncoupled from another machine section with the lifting and lining unit and the tamping unit during a work operation and is powered with its own traction drive. The machine section for rail reprofiling temporarily acts as a drone. During this detached work phase, the drone continues to use control data from the tamping machine section. If necessary, the drone remains connected to the tamping machine section via a flexible supply line so that the need for an energy storage is eliminated.

BRIEF DESCRIPTION OF THE DRAWINGS

In the following, the invention is explained by way of example with reference to the accompanying figures. The following figures show in schematic illustrations.

DESCRIPTION OF THE EMBODIMENTS

Figure 1:
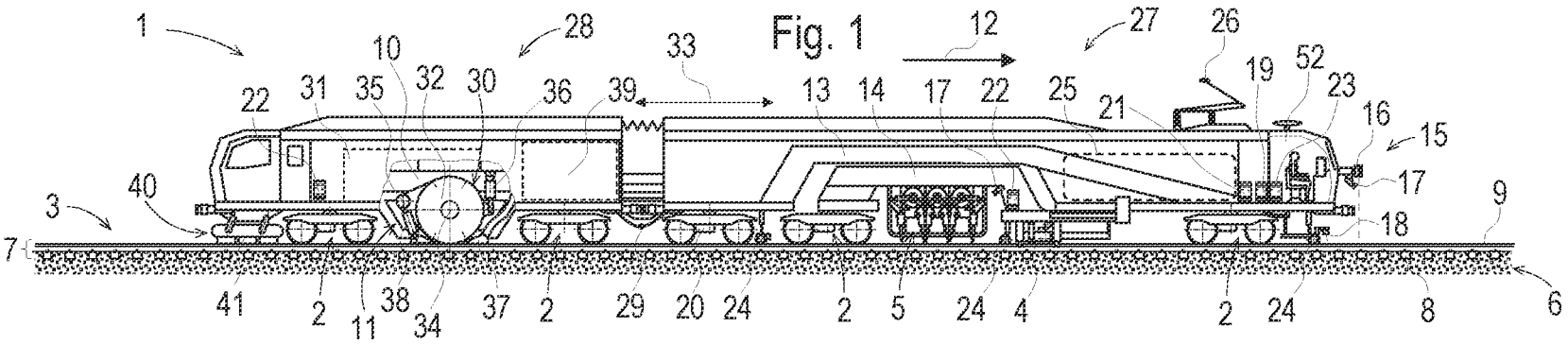
FIG. 1 Maintenance machine for lifting, lining, and tamping a track and for rail reprofiling FIG. 2 Maintenance machine with several milling tools FIG. 3 Maintenance machine for lifting, lining, tamping, and stabilizing a track and for rail reprofiling FIG. 4 Maintenance machine with a machine section that can be decoupled for rail reprofiling FIG. 5 Machine according to FIG. 4 in uncoupled state FIG. 6 Maintenance machine with a rail treatment unit for rail reprofiling on a satellite frame

The respective maintenance machine 1 shown in FIGS. 1 to 6 is movable on rail-based running gears 2 on a track 3 and comprises a lifting and lining unit 4 for track lifting and lining and a tamping unit 5 for track tamping. The superstructure of the track 3 comprises a track panel 7 supported on a ballast bed 6 with rails 9 fastened to sleepers 8. A rail treatment unit 11 is arranged on a machine frame 10 for continuous reprofiling of the rails 9 of the track 3 in use. The machine frame 10 is, in the simplest case, a longitudinal beam that is supported on rail-based running gears 2 positioned at the end. In accordance with the present invention, machine frame 10 may also be understood to mean a self-supporting vehicle body.

FIGS. 1 to 5 each show a maintenance machine 1 moving continuously forward in a working direction 12 during a work operation. Here, the lifting and lining unit 4 and the tamping unit 5 are arranged so as to be shiftable in a longitudinal direction of the machine 33 in relation to a main frame 13. For example, a separate machine frame 14 is designed as the frame of a so-called satellite. This satellite frame is supported at a rear end on its own rail-based running gear 2 and is shiftably mounted at a front end on the main frame 13. By means of a satellite drive, a relative movement of the satellite together with the lifting and lining unit 4 and the tamping unit 5 takes place in relation to the main frame 13.

During operation, cyclic tamping processes are carried out by means of the tamping unit 5. In these processes, the track panel 7 is held in place by the lifting and lining unit 4 and brought into the specified track position by means of actuating drives. This position is fixed by means of the tamping unit 5, with tamping tines, which are set into vibration, being inserted into the ballast bed 6 between the sleepers 8 and being squeezed towards each other. In this way, the ballast grains are set into motion and pushed below the sleepers 8.

During a tamping cycle, the satellite with the tamping unit 5 remains positioned above the currently tamped sleepers 8. Meanwhile, the main machine carrying the satellite moves forward continuously in the working direction 12. As soon as one tamping cycle is completed, the satellite overtakes the main machine and stops above the next sleepers 8 to be tamped. In this way, a continuous forward movement of the maintenance machine 1 together with the rail treatment unit 11 for rail reprofiling takes place.

The variants shown comprise multi-part machine frames 10, 13, 14. In a simpler variant not shown, the machine frame 10, to which the rail treatment unit 11 is attached, forms the main frame 13 of the maintenance machine 1.

Advantageously, the maintenance machine 1 comprises an assistance system disclosed in A 519739 A1. Here, a sensor device 15 is arranged on the front end of the track maintenance machine 1, as seen in a direction of work 12. This sensor device 15 comprises, for example, a laser rotation scanner 16, a colour camera 17, and several laser line scanners 18. The laser rotation scanner 16 provides a three-dimensional point cloud of the track 3 including its surroundings during forward travel. The laser line scanners 18 are aimed at the rails 9. The colour camera 17 continuously captures photographic representations of the track 3.

The data captured by means of the sensor device 15 is processed in a computing unit 19 and stored in a suitable memory unit. First, a three-dimensional model of the track 3 and its surroundings is calculated from the point cloud and the colour representations. By means of an object recognition disclosed in the above mentioned AT 518692 A1, sleepers 8, sleeper cribs, rails 9 including rail defects, and obstacles are identified in the model.

Typically, over time, travelling on rails 9 leads to surface disruptions (head checks), depressions (squats), laps or corrugations/short-wave corrugations. The camera images are used to detect such rolling contact fatigue damages to the rails 9. If necessary, eddy current methods, ultrasound methods, or magnetic resonance methods with the respective sensor technology are also used to detect various rail defects. The extent of the detected damages determines the necessary material removal by the rail treatment unit 11.

Subsequently, the usability of the work units 4, 5, 11 is checked for each track point at which a work process is to be carried out. For example, sleeper cribs that are accessible for the tamping unit 5 are detected. For the lifting and lining unit 4, the best possible rail gripping positions are determined. For the rail treatment unit 11, an engagement depth for the machining tools to be used is determined on the basis of the identified rail defects. To avoid collisions with detected obstacles, the working position of the respective work unit 4, 5, 11 is changed automatically, if necessary. For example, individual tools of the rail treatment unit 11 are raised forming an engagement ramp and re-engaged with the associated rail 9 after encountering an obstacle.

A central control device 21 is advantageously arranged for actuating a machine traction drive 20, the satellite drive as well as various working-mode drives of the work units 4, 5, 11. This device continuously receives data from the computing unit 19 and adjusts actuation of the work units 4, 5, 11 as well as the travelling speeds of the main machine and the satellite to the conditions of the track 3. As soon as an interruption of work is necessary for one work unit 4, 5, 11, the central control device 21 intervenes in the control sequence of the other work units 4, 5, 11 according to a specified control scenario.

Advantageously, a respective drive control 22 translates the specifications of the central control device 21 into specific control signals for operating the working-mode drives. For remotely controlling and monitoring the work units 4, 5, 11, additional cameras 17 are advantageously arranged.

The track position is corrected by means of a so-called guiding computer 23. During a track position correction, the track geometry is continuously measured by means of a measuring system 24 arranged on the machine 1 with measuring chords and/or optical measuring devices. To achieve the desired track position, the guiding computer 23 provides previously determined target values. The working-mode drives of the lifting and lining unit 4 are actuated in an appropriate manner so that the measured track geometry is adapted to the desired track position.

Furthermore, the maintenance machine 1 comprises an energy supply device 25. In a simple variant, a diesel engine supplies the necessary energy for the traction drives 20 and the working-mode drives of the work units 4, 5, 11 via a generator and/or a pump distributor gearbox. Advantageously, a hybrid solution is provided in which an internal combustion engine is only used when there is no overhead line to supply electrical energy. If an active overhead line is present, the power supply to an electric motor is provided by a current collector 26, a high-voltage module, a transformer, and a power converter. A pump distributor gearbox is coupled to both the internal combustion engine and the electric motor. Connected hydraulic pumps are components of a hydraulic system for supplying hydrostatic traction drives 20 and hydraulic working-mode drives.

The present invention enables a particularly efficient energy management because only one energy supply device 25 is required for the combined track maintenance work. The location of the energy supply device 25 within the maintenance machine 1 can be adapted to the specific embodiments of the individual work units 4, 5, 11.

Figure 2:
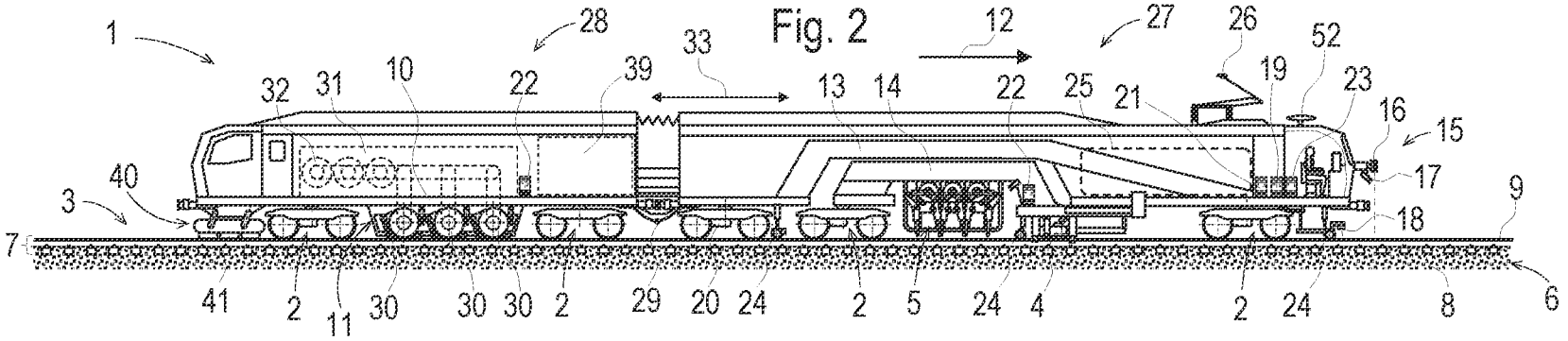

In the machines 1 according to FIGS. 1 and 2, the energy supply device 25 is arranged in a first machine section 27. This front machine section 27 comprises the lifting and lining unit 4 and the tamping unit 5 and thus forms a tamping machine section. A second machine section 28 is coupled to the tamping machine section. The latter comprises the rail treatment unit 11 and is connected to the energy supply device 25 via a supply line 29. In the simplest case, the rail treatment unit 11 is a grinding unit, preferably with several grinding bodies arranged one behind the other. However, a large number of such grinding bodies is necessary to ensure sufficient material removal in one pass.

In FIG. 1, the rail treatment unit 11 comprises a tool 30 for peripheral milling or planing in the second machine section 28. In peripheral milling, the rail head surface is machined by the circumferential cutting edges of the tool 30. The tool circumference determines the surface. The present invention also includes rail treatment units 11 for face milling or profile milling. In face milling, the rail head surface is machined by cutting edges arranged on the front end of the tool. Profile milling is a combination of peripheral and face milling. The transitions from the peripheral cutting edge to the face cutting edge are fluid. Face milling and profile milling is particularly suitable for smoothing the rail surface after peripheral milling.

The respective tool 30 comprises a base body in which replaceable cutting edges are fixed. Advantageously, the base body has sectors on the circumference that can be dismantled separately. When installed, the sectors are connected to a base through precise centring. In this way, additional sectors can be fitted with new or turned cutting-inserts in the dismantled state. As soon as the cutting edges on the tool 30 are worn out, only the entire sectors are replaced in a replacement device 31. This reduces the time required considerably because the cutting-inserts do not have to be replaced directly on the tool 30.

Rail surfaces are usually milled with cutting edges that have a negative rake angle. For peripheral milling or profile milling, a jointed tool with a centred cutting point is advantageously used. The so-called jointing enables an even protrusion of all circumferentially arranged cutting edges. Concentricity errors are eliminated. This makes it possible to achieve a particularly uniform machining surface.

In the example shown in FIG. 1, a large milling tool 30 is assigned to each rail 9, for example with an outer diameter of approx. 1500 mm. In this, very flat traces of engagement are achieved, so that subsequent smoothing can be omitted in some cases. Each milling tool 30 comprises a milling cutter head 32 with an axis of rotation 34 aligned transversely to the longitudinal direction of the machine 33. A housing of the milling cutter head 32 is mounted on the machine frame 10 so as to be swivelable about a swivelling axis 35 aligned parallel to the axis of rotation 34. The housing together with the milling cutter head 32 can be swivelled about this swivelling axis 35 in relation to the associated rail 9 by means of an actuating drive 36. For treating the rails 9, the respective milling cutter head 32 is lowered by swivelling it downwards on the associated rail 9.

The respective milling cutter head 32 is advanced against the rail 9 by means of sliding shoes 37. The sliding shoes 37 are arranged in front of and behind the milling cutter head 32 in the working direction 12 and support the housing together with the milling cutter head 32 on the associated rail 9. By means of a further actuating drive 38, the milling cutter head 32 is adjustable relative to a sliding shoe 37, allowing the desired engagement depth to be set.

During counter-clockwise treatment, the front sliding shoe 37 has a hollow design to receive the material chips. The material chips are conveyed into a receptacle 39 via a suction device connected to the sliding shoe 37. The receptacle 39 is advantageously arranged on the second machine section 28. The receptacle 39 is emptied via a side opening at the end of a work operation.

For removing the traces of engagement created during peripheral milling, a smoothing device 40 is arranged downstream of the rail treatment unit 11 in the working direction 12. This is, for example, a grinding tool with grinding stones 41 that are moved back and forth cyclically in the longitudinal direction of the rail. Alternatively or additionally, other grinding tools can be used, for example a belt sander 42. The smoothing device 40 may also comprise grinding bodies for peripheral, profile or face grinding. Another alternative is a work unit for face milling or profile milling. Appropriate milling techniques leave no disturbing traces of engagement.

The same arrangement is also used for peripheral planing. In this, the cutter head 32 is fitted with cutting edges that have a positive rake angle. In a preferred embodiment, the cutting edges are attached to rams that are mounted to be radially shiftable in a base body. During a planing process, the engaged cutting edges are guided approximately in the longitudinal direction of the rail by means of a slotted-guide-like control arranged inside the cutter head 32. With a peripheral planing tool modified in this way, traces of engagement are largely avoided.

In the event of a necessary interruption of work of the tamping machine section 27, the central control device 21 intervenes in the actuation of the milling tool 30. The same applies if a predefined tamping cycle time is exceeded, for example if a sleeper 8 must be tamped several times until the optimum compaction of the ballast is achieved. Advantageously, a method described in AT 520056 A1 is used to automatically check the ballast compaction. This enables automatic prediction of longer tamping cycles. As a result, it is possible to react in time with an adapted advance speed of the rail treatment.

In case of a longer interruption or delay of the tamping process, the milling tool 30 is disengaged, with the exact position of the interruption of work being stored. A safety buffer for the relative movement of the satellite in relation to the main machine is used to guide the milling tool 30 along a ramp out of the material engagement. Subsequently, the satellite or, if necessary, the entire machine 1 is reset and rail treatment is continued at the stored position with an engagement ramp.

The machine 1 in FIG. 2 largely corresponds to the machine 1 in FIG. 1 with a different rail treatment unit 11 for rail reprofiling. Instead of one large milling or planing tool 30, three smaller milling tools 30 are arranged here per rail 9 for peripheral milling, for example with an outer diameter of approx. 600 mm. Various milling tools 30 can be combined with each other in different variants. In a first variant, all milling tools 30 assigned to a rail 9 cover the profile section of the rail head profile to be treated. In this case, the foremost milling cutter head 32 is designed as a roughing cutter and the two following milling cutter heads 32 are designed as finishing cutters. With this combination, particularly high material removal rates are possible in one pass.

In an alternative variant, the cutter heads 32 arranged one behind the other are assigned to different profile sections of the rail head profile to be treated. This combination allows different treatment operations by engaging either all or only individual cutter heads 32 with the associated rail 9. This makes it possible, for example, to quickly adapt to different rail profiles. In a turnout or crossing area, individual cutter heads 32 can be raised to avoid collisions with a common crossing or a crossing rail 9.

The suspension of the individual milling tools 30 on the machine frame 10 essentially corresponds to the design of the large milling tool 30 as shown in FIG. 1. A smoothing device 40 is also arranged downstream of the rail treatment unit 11. To replace a milling tool 30 with worn cutting edges, another replacement device 31 is provided. Here, the entire milling cutter heads 32 are replaced and fitted with new or turned cutting-inserts. Due to the smaller size, several spare cutter heads 32 can also be carried here. This also allows quick tool changes to adapt to different rail head profiles.

Figure 3:
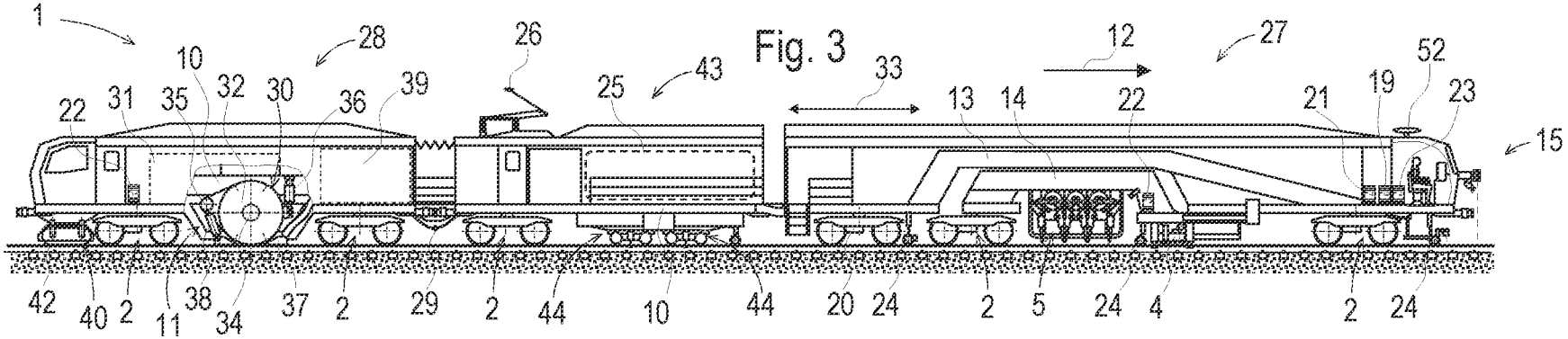

The maintenance machine 1 in FIG. 3 comprises an extension for track stabilization. For this purpose, a third machine section 43 is arranged between the first machine section 27 for track lifting and lining and track tamping and the second machine section 28 for rail reprofiling. The third machine section 43 is connected to the first machine section 27 via a hingedly connection and comprises the energy supply device 25. Two stabilizing units 44 are attached to the associated machine frame 10. These are lowered onto the rails 9 during a work operation. Via spread wheel-flange rollers and rail clamps, vibration is transmitted to the track panel 7 in order to stabilize it in the ballast bed 6 after track tamping.

By means of the stabilizing units 44, the ballast stones are transformed into an even denser structure. With this stabilizing process, settlements of the track panel 7 are effected in a controlled manner that would otherwise occur in an uncontrolled manner due to subsequent rail traffic. This creates optimal conditions for rail reprofiling. The stabilized support of the track panel 7 provides a completely uniform counter pressure during rail milling. This means that even large engagement depths can be set with a correspondingly increased pressure on the rails 9 during milling without reducing the quality of the work result.

In an advantageous further development, the stabilizing units 44 are used to check the rail fastenings of the treated track section. A modified spreading drive is used within the respective work unit 44. Specifically, the spreading drive is adapted to apply a modulated spreading force to the rails 9. Accordingly, the spreading drive is not only intended to press the wheel-flange rollers against the inside of the respective rail head without play. Rather, a variable spreading force is specified, which is subsequently set in relation to a measured track gauge or track gauge difference. The track gauge or the track gauge difference is measured by means of a suitable measuring device, which comprises, for example, an electromechanical distance sensor that is coupled to the spreading axle. The track gauge change caused by a change to the spreading force subsequently provides information about the condition of the respective rail fastening. This increases the quality of rail treatment because loose rail fastenings are detected in good time. If necessary, the advance speed of the milling tool 30 is adapted to a reduced fastening stability of a rail section.

The second machine section 28 shown in FIG. 3 with the rail treatment unit 11 corresponds essentially to that in FIG. 1. One large milling tool 30 is arranged per rail 9. A belt sander 42 is used here as the final smoothing device 40.

Figure 4:
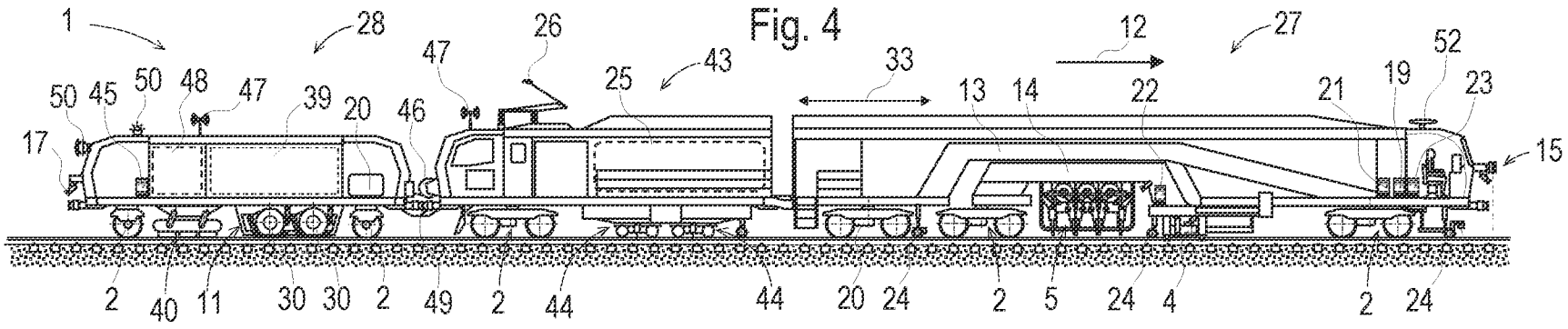
Figure 5:
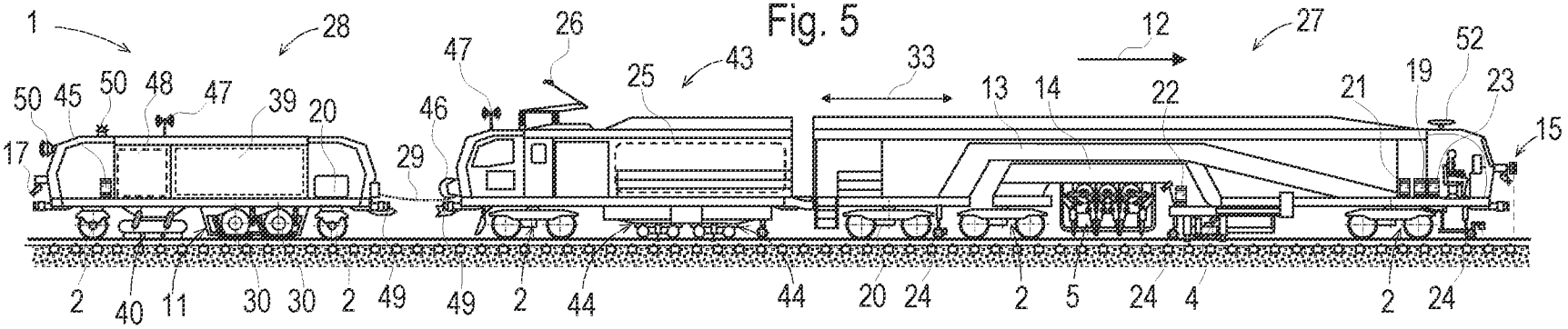

FIGS. 4 and 5 also show a maintenance machine 1 with stabilizing units 44. In the embodiment shown, the second machine section 28 can be temporarily uncoupled from the third machine section 42. In operation, the second machine section 28 works as a drone. For this purpose, the second machine section 28 has its own traction drive 20 and its own control device 45. Energy is supplied to the drone by the energy supply device 25 via a supply line 29.

In one variant, the drone remains connected to the other machine sections 27, 43 via the supply line 29 during a work operation. In this case, the supply line 29 is, for example, arranged in a cable drum 46 in a way that it can be pulled out. Control data is advantageously transmitted by means of radio modules 47 via an air interface. Control data is transmitted to the drone via the central control device 21, in particular speed specifications and data on rail defects and obstacles in the track 3.

Another drone variant comprises an electrical energy storage 48 which is chargeable by means of the energy supply device 21 via the supply line 29. During a work operation, the supply line 29 is temporarily disconnected via a connector device and the drone is supplied from the energy storage 48. The capacity of the energy storage 48 is designed in such a way that continuous rail reprofiling can be carried out during a track possession.

During operation, both the connector device of the supply line 29 and a coupling device 49 are automatically released and connected. In this way, no staff is required at the track 3 to perform the uncoupling or coupling of the drone. In the uncoupled state, a danger zone around the drone is monitored by means of cameras 17. In addition, optical and acoustic warning devices 50 are arranged on the drone.

Figure 6:
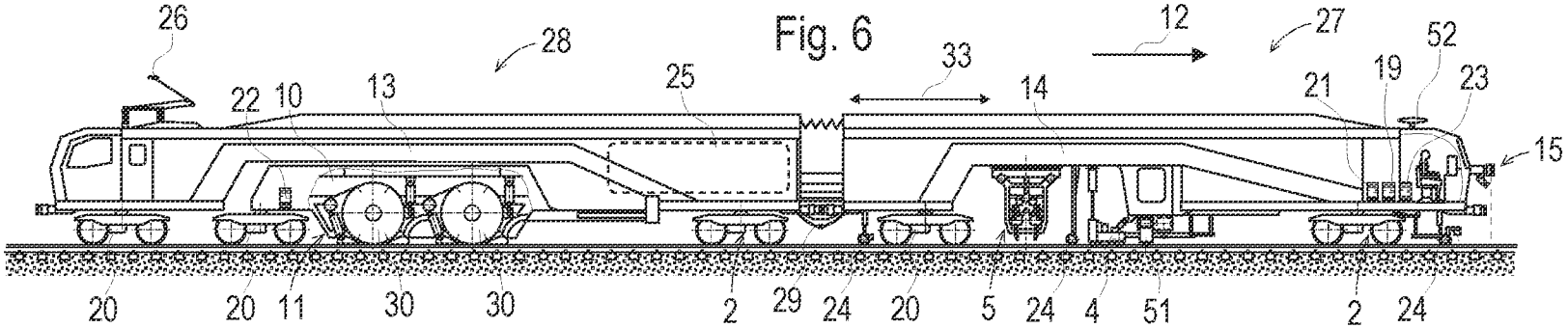

A further variant of the maintenance machine 1 is shown in FIG. 6. This vehicle formation moves forward cyclically in working direction 12 during operation. During a tamping cycle, the machine 1 stops for the duration of one tamping process. Here, the first machine section 27 comprises an additional lifting unit 51 in addition to the lifting and lining unit 6. With this, a diverging rail 9 in a turnout area is detected and lifted. The tamping unit 5 is equipped with tilting tamping tines for tamping turnouts.

In the second machine section 28, the energy supply device 25 and the rail treatment unit 11 for rail reprofiling are arranged. The energy supply device 25 is also used to supply the tamping machine section 27. The rail treatment unit 11 comprises two milling tools 30 per rail 9 that are arranged one behind the other, with a large outer diameter (approx. 1500 mm) for peripheral or profile milling. Preferably, the front milling tool 30 is designed as a roughing cutter. The rear milling tool 30 is a finishing cutter that works with a low engagement depth. With this, a high surface quality with negligible traces of treatment is achieved. Smoothing by means of a separate smoothing device 40 can be omitted.

In order to enable a continuous treatment of the rails 9 despite the cyclic forward movement of the machine 1, the rail treatment unit 11 is attached on a separate machine frame 10. With a rear support on a rail-based running gear 2 and a front shiftable support on a main frame 13, this arrangement forms a satellite. During operation, the satellite is continuously moved along the track 3 at a constant advance speed by means of its own drive 20. The advance speed, the respective tamping cycle duration and the relative movement between the main machine and the satellite are coordinated with each other by means of the central control device 21.

During a rail treatment operation, supports of the rail-based running gears 2 are activated. In this, suspension travel between the rail wheels and the running gear frame as well as between the rail-based running gears 2 and the machine frame 10, 13, 14 is blocked. As support elements, for example, one hydraulic cylinder per wheel suspension is arranged on the respective running gear frame and another hydraulic cylinder is arranged on the associated spring plate or axle bearing. Blocking the hydraulic flow activates the support so that there is a clear positioning of the machining tools 30 in relation to the rails 9.

For a local allocation, a position detection system is advantageously set up on the maintenance machine 1. This comprises, for example, a fixed-point detection device disclosed in AT 518579 A1. This makes it possible to determine an absolute track position. Other components of the position detection system include, for example, an odometer, an inertial measurement unit (IMU) and a GNSS receiver 52. The exact local and spatial detection of the maintenance machine 1 allows a comparison with previously collected track data as well as a location-specific logging of the work results.

All maintenance machines 1 shown are exemplary combinations of the individual system components or machine sections 27, 28, 43. The invention further comprises other combinations. In particular, the shown work units 4, 5, 11, 40, 44, 51 can be arranged in varying order, design and composition.

The invention claimed is:

1. An on-track maintenance machine for maintaining a superstructure with a track panel formed of sleepers and rails fixed thereon that is supported on a ballast bed, the machine comprising:

a lifting and lining unit for track lifting and lining a plurality of machine frames;

a tamping unit for track tamping, wherein at least one rail treatment unit for continuous reprofiling of the rails is arranged on a machine frame;

a satellite drive;

wherein said lifting and lining unit and said tamping unit are arranged on separate machine frames of said plurality of machine frames and at least one of the machine frames is designed as a satellite frame shiftable in relation to a main frame in the longitudinal direction of the machine by means of said satellite drive.

2. The maintenance machine according to claim 1, wherein the rail treatment unit is arranged downstream of the lifting and lining unit and the tamping unit in a working direction.

3. The maintenance machine according to claim 1, wherein the rail treatment unit comprises a milling tool, which in particular has a milling cutter head with an axis of rotation aligned transversely to a longitudinal direction of the machine.

4. The maintenance machine according to claim 3, wherein the rail treatment unit comprises several milling tools arranged one behind the other and that in particular a front milling tool is designed as a roughing cutter and a rear milling tool is designed as a finishing cutter.

5. The maintenance machine according to claim 1, wherein the rail treatment unit comprises a planing tool which, in particular, has cutting bodies that are designed to be movable in relation to a base body.

6. The maintenance machine according to claim 1, wherein a smoothing device, in particular a grinding tool, is arranged downstream of the rail treatment unit in the working direction.

7. The maintenance machine according to claim 1, wherein a stabilizing unit is arranged downstream of the tamping unit in the working direction.

8. The maintenance machine according to claim 1, wherein a first machine section comprises the lifting and lining unit and the tamping unit and that a second machine section coupled to the first machine section comprises the rail treatment unit for reprofiling the rails.

9. The maintenance machine according to claim 8, wherein an energy supply device is set up on one machine section and that the other machine section is connected to the energy supply device via a supply line.

10. The maintenance machine according to claim 9, wherein the supply line has a detachable connection between the machine sections that the second machine section comprises an energy storage and that the energy storage is chargeable via the supply line.

11. A method for operating a maintenance machine according to claim 1, wherein the track panel is lifted and lined on a track section by means of the lifting and lining unit, that the sleepers of the track panel are tamped by means of the tamping unit and that the rails of the track panel are reprofiled by means of the rail treatment unit.

12. The method according to claim 11, wherein the lifting and lining unit and the tamping unit are moved forward in the working direction during successive work cycles and that the rail treatment unit for reprofiling the rails is moved continuously in the working direction at a speed adapted to a duration of the work cycles.

13. The method according to claim 11, wherein the lifting and lining unit, the tamping unit, the rail treatment unit for reprofiling the rails, a machine traction drive and, if necessary, a satellite drive are actuated in a coordinated manner via a central control device.

14. The method according to claim 11, wherein a machine section with the rail treatment unit for reprofiling the rails is uncoupled from another machine section with the lifting and lining unit and the tamping unit during a work operation and is powered with its own traction drive.

* * * * *